US010872572B2

(12) United States Patent
Shang et al.

(10) Patent No.: US 10,872,572 B2
(45) Date of Patent: Dec. 22, 2020

(54) GATE DRIVING CIRCUIT AND METHOD FOR CONTROLLING THE SAME, AND DISPLAY APPARATUS

(71) Applicant: BOE Technology Group Co., Ltd., Beijing (CN)

(72) Inventors: Guangliang Shang, Beijing (CN); Seungwoo Han, Beijing (CN); Lijun Yuan, Beijing (CN); Mingfu Han, Beijing (CN); Haoliang Zheng, Beijing (CN); Xing Yao, Beijing (CN); Zhenyu Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/556,960

(22) Filed: Aug. 30, 2019

(65) Prior Publication Data

US 2020/0126487 A1 Apr. 23, 2020

(30) Foreign Application Priority Data

Oct. 23, 2018 (CN) ..... 2018 1 1236862

(51) Int. Cl.
*G09G 3/3275* (2016.01)
*G09G 3/36* (2006.01)

(52) U.S. Cl.
CPC ..... *G09G 3/3275* (2013.01); *G09G 3/3685* (2013.01); *G09G 2310/0202* (2013.01)

(58) Field of Classification Search
CPC combination set(s) only.
See application file for complete search history.

(56) References Cited

U.S. PATENT DOCUMENTS 6,076,136 A * 6/2000 Burroughs ..... G06F 12/04 365/230.03
2002/0161969 A1* 10/2002 Nataraj ..... G06F 16/90339 711/108

(Continued)

*Primary Examiner* — Van N Chow
(74) *Attorney, Agent, or Firm* — Westman, Champlin & Koehler, P.A.

(57) ABSTRACT

The embodiments of the present disclosure provide a gate driving circuit and a method for controlling the same, and a display apparatus. The gate driving circuit includes: M decoding sub-circuits, wherein each of the M decoding sub-circuits has K signal input terminals and $2^K$ signal output terminals, where K=N/M, M, N and K are positive integers, 4≤M<N, and K≥2, N signal input terminals of the M decoding sub-circuits are connected to receive N-bit address data, and each of the M decoding sub-circuits is configured to receive respective K-bit data in the N-bit address data at K signal input terminals thereof, and select one of the $2^K$ signal output terminals thereof which matches the received K-bit data; and a plurality of driving sub-circuits, wherein each of the plurality of driving sub-circuits is connected to M signal output terminals belonging to the M decoding sub-circuits respectively according to an address allocated thereto, and is configured to output a row driving signal when the M signal output terminals connected to the driving sub-circuit are all selected.

19 Claims, 6 Drawing Sheets

(56) References Cited

U.S. PATENT DOCUMENTS

| | | | | |
|---|---|---|---|---|
| 2006/0002204 | A1* | 1/2006 | Nam | G11C 29/787<br>365/200 |
| 2010/0128019 | A1* | 5/2010 | Harada | G09G 3/3611<br>345/212 |
| 2015/0089333 | A1* | 3/2015 | Hosp | G06F 11/1004<br>714/807 |
| 2017/0330509 | A1* | 11/2017 | Cok | G09G 3/2014 |
| 2020/0254444 | A1* | 8/2020 | Long | B01L 3/502792 |

* cited by examiner

GATE DRIVING CIRCUIT AND METHOD FOR CONTROLLING THE SAME, AND DISPLAY APPARATUS

CROSS-REFERENCE TO RELATED APPLICATION(S)

This application claims priority to the Chinese Patent Application No. 201811236862.9, filed on Oct. 23, 2018, which is incorporated herein by reference in its entirety.

TECHNICAL FIELD

The present disclosure relates to the field of display technology, and more particularly, to a gate driving circuit and a method for controlling the same, and a display apparatus.

BACKGROUND

A gate driving circuit for outputting row driving signals is provided in a display apparatus. A gate driving circuit based on the Gate Driver on Array (GOA) technology comprises a plurality of cascaded shift registers, wherein each stage of shift register outputs a row driving signal to drive a respective pixel row. However, in the gate driving circuit, after a certain stage of shift register fails, it may result in that other shift registers which are cascaded with the stage of shift register cannot output a row driving signal normally, thereby affecting the display.

SUMMARY

Embodiments of the present disclosure provide a gate driving circuit and a method for controlling the same, and a display apparatus.

According to an aspect of the embodiments of the present disclosure, there is provided a gate driving circuit, comprising:

M decoding sub-circuits, wherein each of the M decoding sub-circuits has K signal input terminals and $2^K$ signal output terminals, where K=N/M, M, N and K are positive integers, $4 \leq M < N$, and $K \geq 2$, N signal input terminals of the M decoding sub-circuits are connected to receive N-bit address data, and each of the M decoding sub-circuits is configured to receive respective K-bit data in the N-bit address data at K signal input terminals thereof, and select one of the $2^K$ signal output terminals thereof which matches the received K-bit data; and a plurality of driving sub-circuits, wherein each of the plurality of driving sub-circuits is connected to M signal output terminals belonging to the M decoding sub-circuits respectively according to an address allocated thereto, and is configured to output a row driving signal when the M signal output terminals connected to the driving sub-circuit are all selected.

In an example, the decoding sub-circuit comprises:

K inverters, wherein each of the K inverters has an input terminal connected to a respective one of the K signal input terminals, and is configured to invert a signal at an input terminal thereof and output the inverted signal at an output terminal thereof; and $2^K$ logic gates, wherein each of the $2^K$ logic gates has K input terminals connected to K inverters respectively with each of the K input terminals being connected to an input terminal or output terminal of a respective one of the K inverters, and an output terminal acting as one of the $2^K$ signal output terminals of the decoding sub-circuit, and each of the logic gates is configured to output, to an output terminal thereof, a valid signal indicating that the output terminal is selected or an invalid signal indicating that the output terminal is not selected according to signals at K input terminals of the logic gate.

In an example, the logic gate comprises at least one of a NAND gate, a NOR gate, an AND gate or an OR gate.

In an example, N=8, M=4, K=2, the K inverters comprises a first inverter and a second inverter, and the $2^K$ logic gates comprise a first NAND gate, a second NAND gate, a third NAND gate, and a fourth NAND gate, wherein an input terminal of the first inverter is connected to one of two signal input terminals of the decoding sub-circuit;

an input terminal of the second inverter is connected to the other of the two signal input terminals;

the first NAND gate has a first input terminal connected to an output terminal of the first inverter, a second input terminal connected to an output terminal of the second inverter, and an output terminal acting as a first signal output terminal of the decoding sub-circuit;

the second NAND gate has a first input terminal connected to an input terminal of the first inverter, a second input terminal connected to the output terminal of the second inverter, and an output terminal acting as a second signal output terminal of the decoding sub-circuit;

the third NAND gate has a first input terminal connected to the output terminal of the first inverter, a second input terminal connected to the input terminal of the second inverter, and an output terminal acting as a third signal output terminal of the decoding sub-circuit; and the fourth NAND gate has a first input terminal connected to the input terminal of the first inverter, a second input terminal connected to the input terminal of the second inverter, and an output terminal acting as a fourth signal output terminal of the decoding sub-circuit.

In an example, the driving sub-circuit comprises:

an input sub-circuit connected to one of the $2^K$ signal output terminals of each of the decoding sub-circuits and configured to provide a transmission control signal when the signal output terminals connected to the input sub-circuit are all selected;

a display control sub-circuit connected to the input sub-circuit, a clock signal terminal, and a display control terminal, and configured to perform a logic operation on signals at the clock signal terminal and the display control terminal under control of the transmission control signal from the input sub-circuit; and a first power amplification sub-circuit connected to the display control sub-circuit and configured to amplify a result of the logical operation of the display control sub-circuit and output the amplified result as a first row driving signal.

In an example, the input sub-circuit comprises:

a NOR gate having M input terminals connected to the M decoding sub-circuits respectively, wherein each of the M input terminals is connected to a respective one of signal output terminals of a respective decoding sub-circuit; and a third inverter having an input terminal connected to an output terminal of the NOR gate, and an output terminal connected to the display control sub-circuit to provide the transmission control signal to the display control sub-circuit.

In an example, the display control sub-circuit comprises:

a transmission gate having a control terminal connected to the input sub-circuit to receive the transmission control signal, and an input terminal connected to the clock signal terminal;

a fifth NAND gate having a first input terminal connected to an output terminal of the transmission gate, and a second input terminal connected to the display control terminal; and a fourth inverter having an input terminal connected to the output terminal of the fifth NAND gate, and an output terminal connected to the first power amplification sub-circuit.

In an example, the first power amplification sub-circuit comprises:

a fifth inverter having an input terminal connected to the output terminal of the fourth inverter; and a sixth inverter having an input terminal connected to the output terminal of the fifth inverter, and an output terminal acting as a first output terminal of the driving sub-circuit for outputting the first row driving signal.

In an example, a size of each of the fifth inverter and the sixth inverter is greater than that of the fourth inverter.

In an example, the driving sub-circuit further comprises: a second power amplification sub-circuit connected to the display control sub-circuit, and configured to amplify the result of the logical operation of the display control sub-circuit and output the amplified result as a second row driving signal.

In an example, the first row driving signal is at a high level, and the second row driving signal is at a low level; or the first row driving signal is at a low level, and the second row driving signal is at a low level.

In an example, the second power amplification sub-circuit comprises: a seventh inverter having an input terminal connected to the display control sub-circuit to receive the result of the logical operation from the display control sub-circuit, and an output terminal acting as a second output terminal of the driving sub-circuit for outputting the second row driving signal.

In an example, a size of the seventh inverter is greater than that of the fourth inverter.

According to another aspect of the embodiments of the present disclosure, there is provided a display apparatus, comprising the gate driving circuit described above.

According to yet another aspect of the embodiments of the present disclosure, there is provided a method for controlling the gate driving circuit described above, comprising:

receiving, by each of the M decoding sub-circuits, respective K-bit data in N-bit address data and selecting one of the $2^K$ signal output terminals of the decoding sub-circuit which matches the received K-bit data; and outputting, by one of the plurality of driving sub-circuits connected to a plurality of signal output terminals which are all selected, a row driving signal.

In an example, the decoding sub-circuit comprises K inverters and $2^K$ logic gates, wherein each of the inverters has an input terminal connected to a respective one of the K signal input terminals, and is configured to invert a signal at the input terminal thereof and output the inverted signal at an output terminal thereof, each of the logic gates has K input terminals connected to K inverters respectively with each of the K input terminals being connected to an input terminal or output terminal of a respective one of the K inverters, and an output terminal acting as one of the $2^K$ signal output terminals of the decoding sub-circuit; and receiving respective K-bit data in the N-bit address data and selecting one of the $2^K$ signal output terminals of the decoding sub-circuit which matches the received K-bit data comprises:

inverting, by each inverter, a signal at an input terminal thereof and outputting the inverted signal at an output terminal thereof; and outputting, by each of the logic gates, to an output terminal thereof, a valid signal indicating that the output terminal is selected or an invalid signal indicating that the output terminal is not selected, according to signals at K input terminals of the logic gate.

In an example, the driving sub-circuit comprises an input sub-circuit, a display control sub-circuit, and a first power amplification sub-circuit, and outputting, by one of the plurality of driving sub-circuits connected a plurality of signal output terminals which are all selected, a row driving signal comprises:

providing, by the input sub-circuit, a transmission control signal to the display control sub-circuit when the plurality of signal output terminals connected to the input sub-circuit output a valid signal;

performing, by the display control sub-circuit, a logic operation on signals at the clock signal terminal and the display control terminal under control of the transmission control signal, and transmitting a result of the logical operation to the first power amplification sub-circuit; and amplifying, by the first power amplification sub-circuit, the result of the operation output by the display control sub-circuit and outputting the amplified result as a first row driving signal.

In an example, the driving sub-circuit further comprises a second power amplification sub-circuit, and the method further comprises:

transmitting, by the display control sub-circuit, the result of the logical operation to the second power amplification sub-circuit; and amplifying, by the second power amplification sub-circuit, the result of the logical operation of the display control sub-circuit and outputting the amplified result as a second row driving signal.

In an example, the first row driving signal is at a high level, and the second row driving signal is at a low level; or the first row driving signal is at a low level, and the second row driving signal is at a low level.

BRIEF DESCRIPTION OF THE ACCOMPANYING DRAWINGS

In order to more clearly illustrate the technical solutions in the embodiments of the present disclosure or the related art, the accompanying drawings required to be used in the description of the embodiments or the related art will be briefly described below. Obviously, the accompanying drawings in the following description are only some embodiments of the present disclosure, and other accompanying drawings may further be obtained by those of ordinary skill in the art according to these accompanying drawings without any creative work.

DETAILED DESCRIPTION

The technical solutions in the embodiments of the present disclosure will be clearly and completely described below with reference to the accompanying drawings in the embodiments of the present disclosure. Obviously, the embodiments described are only a part of the embodiments of the present disclosure, instead of all the embodiments. All other embodiments obtained by those of ordinary skill in the art based on the embodiments of the present disclosure without any creative work fall within the protection scope of the present disclosure.

Figure 1:
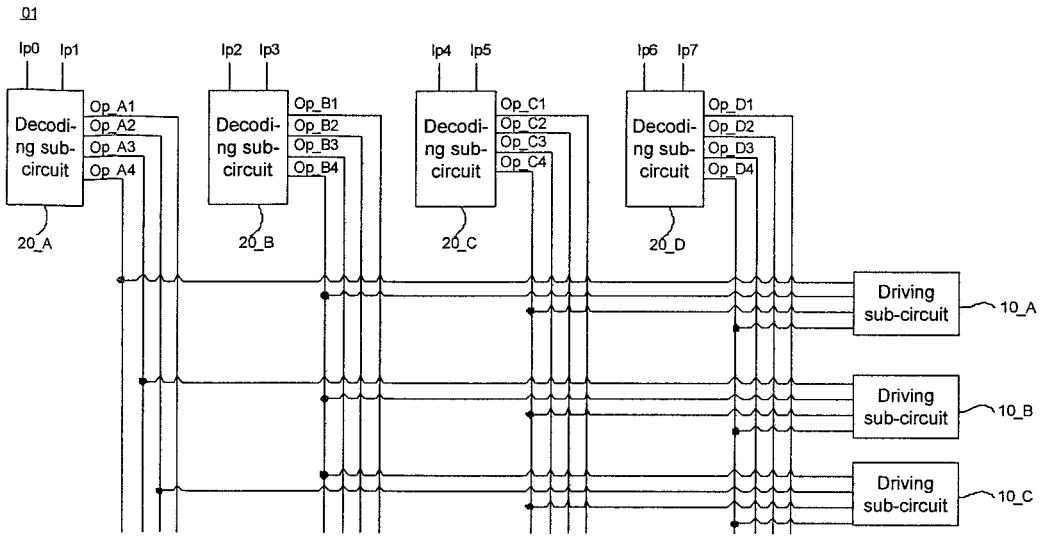
FIG. 1 is a schematic structural diagram of a gate driving circuit according to an embodiment of the present disclosure.

The embodiments of the present disclosure provide a gate driving circuit 01. As shown in FIG. 1, the gate driving circuit 01 comprises a plurality of driving sub-circuits 10_A, 10_B, 10_C, etc. (hereinafter collectively referred to as driving sub-circuits 10). Each driving sub-circuit 10 may be allocated an address which may be represented by N-bit data, where N≥2 and N is a positive integer.

For example, when N=8, the address is represented by 8-bit data. In FIG. 1, an address of the driving sub-circuit 10_A may be "000000000"; an address of the driving sub-circuit 10_B may be "00000001"; an address of the driving sub-circuit 10_C may be "00000010", and so on. When N=10, the address is represented by 10-bit data. The addresses are set in the same manner, and will not be described in detail here. Here, "0" represents a low level, and "1" represents a high level.

The gate driving circuit 01 further comprises M decoding sub-circuits. Each decoding sub-circuit has K signal input terminals and $2^K$ signal output terminals, where 4≤M<N; K=N/M; K≥2; and M, N, K are positive integers.

As shown in FIG. 1, by taking N=8, M=4, and K=2 as an example, the gate driving circuit 01 has four decoding sub-circuits, that is, a decoding sub-circuit 20_A, a decoding sub-circuit 20_B, a decoding sub-circuit 20_C, and a decoding sub-circuit 20_D (hereinafter collectively referred to as decoding sub-circuits 20). Each decoding sub-circuit 20 has two signal input terminals and four signal output terminals. As shown in FIG. 1, the decoding sub-circuit 20_A has signal input terminals Ip0 and Ip1 and signal output terminals Op_A1, Op_A2, Op_A3 and Op_A4; the decoding sub-circuit 20_B has signal input terminals Ip2 and Ip3 and signal output terminals Op_B1, Op_B2, Op_B3 and Op_B4, and so on.

Figure 2:
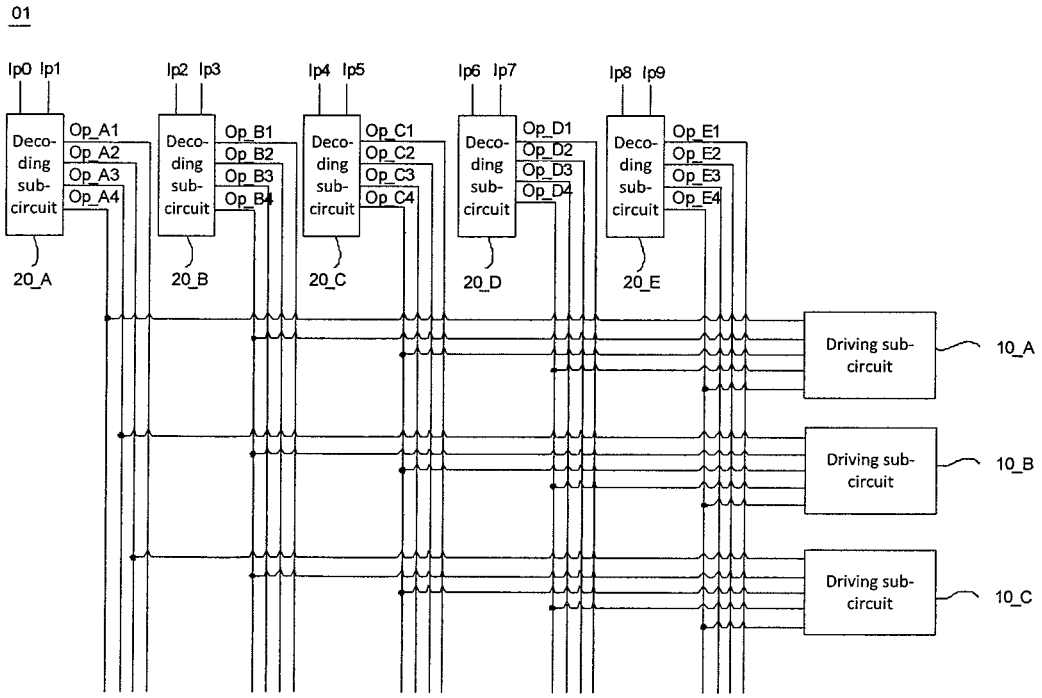
FIG. 2 is a schematic structural diagram of a gate driving circuit according to another embodiment of the present disclosure.

The above description is merely illustrative, and the embodiments of the present disclosure are not limited thereto. A number of decoding sub-circuits 20 in the gate driving circuit 01, as well as a number of signal input terminals and a number of signal output terminals of each decoding sub-circuit 20 may be set as needed. For example, as shown in FIG. 2, N=10, M=5, K=2, the gate driving circuit 01 has five decoding sub-circuits, which are a decoding sub-circuit 20_A, a decoding sub-circuit 20_B, a decoding sub-circuit 20_C, a decoding sub-circuit 20_D and a decoding sub-circuit 20_E respectively, and each decoding sub-circuit has two signal input terminals and four signal output terminals.

Hereinafter, for convenience of explanation, the following description will be made by taking K=2, N=8, and M=4 as an example.

In the gate driving circuit 01, eight signal input terminals Ip_0, Ip_1, . . . , Ip_7 are connected to receive 8 bits of address data of a driving sub-circuit 10 respectively.

For example, when the driving sub-circuit 10_C having address data of "00000010" is to be driven, as shown in FIG. 1, data of "0" and data of "1" are provided to the two signal input terminals Ip0 and Ip1 of the decoding sub-circuit 20_A respectively, data of "0" and data of "0" are provided to the two signal input terminals Ip2 and Ip3 of the decoding sub-circuit 20_B respectively, data of "0" and data of "0" are provided to the two signal input terminals Ip4 and Ip5 of the decoding sub-circuit 20_C respectively, and data of "0" and data of "0" are provided to the two signal input terminals Ip6 and Ip7 of the decoding sub-circuit 20_D respectively.

The decoding sub-circuit 20 decodes the received K-bit data and selects one of the $2^K$ signal output terminals Op to output a valid signal. For example, the decoding sub-circuit 20_A may receive a first bit and a second bit of the 8-bit address data at the signal input terminals Ip0 and Ip1, and select one of the signal output terminals Op_A1, Op_A2, Op_A3, and Op_A4 (for example, the signal output terminal Op_A3 which matches the 2-bit data) according to the received 2-bit data to output a valid signal, and the remaining signal output terminals Op_A1, Op_A2, and Op_A4 each output an invalid signal. By taking the valid signal being a low level signal (represented by "0") as an example, the signal output terminal Op_A3 outputs "0", and the signal output terminals Op_A1, Op_A2, and Op_A4 output "1"; and vice versa when "1" is used as a valid signal, which will not be described in detail here.

Further, as shown in FIG. 1, each driving sub-circuit 10 is connected to M signal output terminals belonging to the M decoding sub-circuits respectively according to an address allocated to the driving sub-circuit 10. The different driving sub-circuits 10 are connected to different groups of multiple signal output terminals Op, to ensure that each driving sub-circuit 10 has unique address data, that is, when the gate driving circuit 01 receives address data, one of the plurality of driving sub-circuits 10 is driven, and an address of the driven driving sub-circuit 10 coincides with the address data received by the gate driving circuit 01. In FIG. 1, the driving sub-circuit 10_A (with an address of "000000000") is connected to the signal output terminals OP_A4, OP_B4, OP_C4 and OP_D4 respectively, the driving sub-circuit 10_B (with an address of "00000001") is connected to the signal output terminals OP_A3, OP_B4, OP_C4 and OP_D4 respectively, the driving sub-circuit 10_C (with an address of "00000010") is connected to the signal output terminals OP_A2, OP_B4, OP_C4 and OP_D4 respectively, and so on.

The driving sub-circuit 10 is configured to output a row driving signal when the signal output terminals Op connected thereto each output a valid signal, and thereby the driving sub-circuit 10 is driven. The row driving signal may be received by a gate line or a signal line in a display panel, so that a transistor controlled by the gate line or the signal line is turned on. For example, when the input signal terminals Ip0 to Ip7 receive the 8-bit address data of "00000001", if the signal output terminals OP_A3, OP_B4, OP_C4, and OP_D4 are all selected (i.e., all outputting a valid signal of "0"), the driving sub-circuit 10_B (with an address coinciding with the received address data of "00000001") connected thereto outputs a row driving signal, and the remaining driving sub-circuits 10_A, 10_C, etc. do not output a row driving signal.

As may be known from the above, in the gate driving circuit 01, each driving sub-circuit 10 has address data. Each decoding sub-circuit 20 receives K address codes (i.e., K-bit data) in the above address data through K signal input terminals Ip thereof, and decodes the address codes to select one of the $2^K$ signal output terminals Op to output a valid signal.

Further, each driving sub-circuit 10 is connected to one signal output terminal Op of each decoding sub-circuit 20. In this case, when all the signal output terminals Op connected to a driving sub-circuit 10 each output a valid signal, the driving sub-circuit 10 is selected to output a row driving signal.

In this way, on the one hand, in the gate driving circuit 01, there is no need to cascade the respective driving sub-circuits 10, and any driving sub-circuit 10 may be selected as long as respective address data of the driving sub-circuit 01 is input, so that the driving sub-circuit 01 outputs a row driving signal. Therefore, even if some of the driving sub-circuits 10 in the gate driving sub-circuit 01 fail and may not output a row driving signal, the remaining driving sub-circuits 10 are not affected and may output a row driving signal normally.

On the other hand, since the gate driving sub-circuit 01 may receive an N-bit data address, but each driving sub-circuit is connected to M signal output terminals, where M<N, it is not necessary to provide N input terminals of the driving sub-circuit 10, which effectively reduces a number of input terminals of the driving sub-circuit 10, thereby achieving the purpose of simplifying the driving sub-circuit 10.

Figure 3:
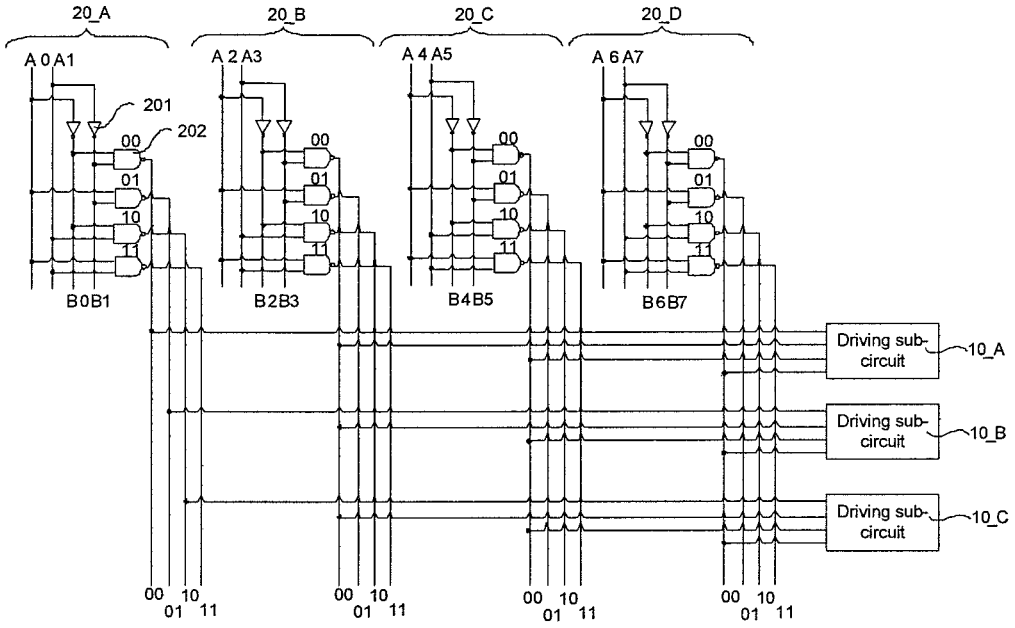
FIG. 3 is a schematic structural diagram of a gate driving circuit according to still another embodiment of the present disclosure.

FIG. 3 is a schematic structural diagram of a gate driving circuit according to still another embodiment of the present disclosure.

Each signal input terminal of the decoding sub-circuit 20 is connected to a respective first input address line. For example, in FIG. 3, two signal input terminals (for example, the signal input terminals Ip0 and Ip1 described above) of the decoding sub-circuit 20_A are connected to two first input address lines A0 and A1 respectively, and two signal input terminals (for example, the signal input terminals Ip0 and Ip1 described above) of the decoding sub-circuit 20_B are connected to two first input address lines A2 and A3 respectively, and so on. First input address lines A0 to A7 receive N-bit address data respectively, wherein each of the first input address lines is used to receive an address code (i.e., one bit in the N-bit address data).

Each decoding sub-circuit 20 comprises K inverters 201 and $2^K$ logic gates 202.

Each inverter 201 has an input terminal connected to a first input address line, and an output terminal connected to a second input address line. Different inverters 201 are connected to different groups of first input address line and second input address line. For example, in FIG. 3, the decoding sub-circuit 20_A comprises two inverters 201, wherein one of the inverters 201 has an input terminal connected to the first input address line A0, and an output terminal connected to a second input address line B0, and the other of the inverters 201 has an input terminal connected to the first input address line A1, and an output terminal connected to a second input address line B1. Two inverters of the decoding sub-circuit 20_B are connected in a similar manner to the first input address lines A2 and A3 and second input address lines B2 and B3, and so on, and will not be described in detail here.

K input terminals of each logic gate 202 are connected to K inverters respectively, wherein each of the K input terminals is connected to an input terminal or an output terminal of a respective one of the K inverters, and an output terminal of each logic gate 202 acts as one of the $2^K$ signal output terminals of the decoding sub-circuit 20.

For example, each logic gate 202 may have two input terminals—a first input terminal and a second input terminal, wherein the first input terminal is connected to a first input address line or a second input address line, and the second input terminal is connected to a first input address line or a second input address line. Different logic gates 202 are connected to different groups of first input address line and second input address line.

The phrase "A connected to B" as described above may refers to "A directly connected to B" or "A indirectly connected to B". For example, in some embodiments, N signal input terminals of the M decoding sub-circuits 20 may be directly connected to receive N-bit address data. For example, the two signal input terminals (for example, the signal input terminals Ip0 and Ip1 described above) of the decoding sub-circuit 20_A may be directly connected to two first input address lines A0 and A1 respectively, and two signal input terminals (for example, the signal input terminals Ip0 and Ip1 described above) of the decoding sub-circuit 20_B may be directly connected to two first input address lines A2 and A3 respectively, and so on. In some embodiments, each of the plurality of driving sub-circuits 10 may be directly connected to M signal output terminals belonging to the M decoding sub-circuits 20 respectively according to an address allocated thereto. For example, in FIG. 1, the driving sub-circuit 10_A (with an address of "000000000") may be directly connected to the signal output terminals OP_A4, OP_B4, OP_C4 and OP_D4 respectively, the driving sub-circuit 10_B (with an address of "00000001") may be directly connected to the signal output terminals OP_A3, OP_B4, OP_C4 and OP_D4 respectively, the driving sub-circuit 10_C (with an address of "00000010") may be directly connected to the signal output terminals OP_A2, OP_B4, OP_C4 and OP_D4 respectively, and so on.

Figure 4:
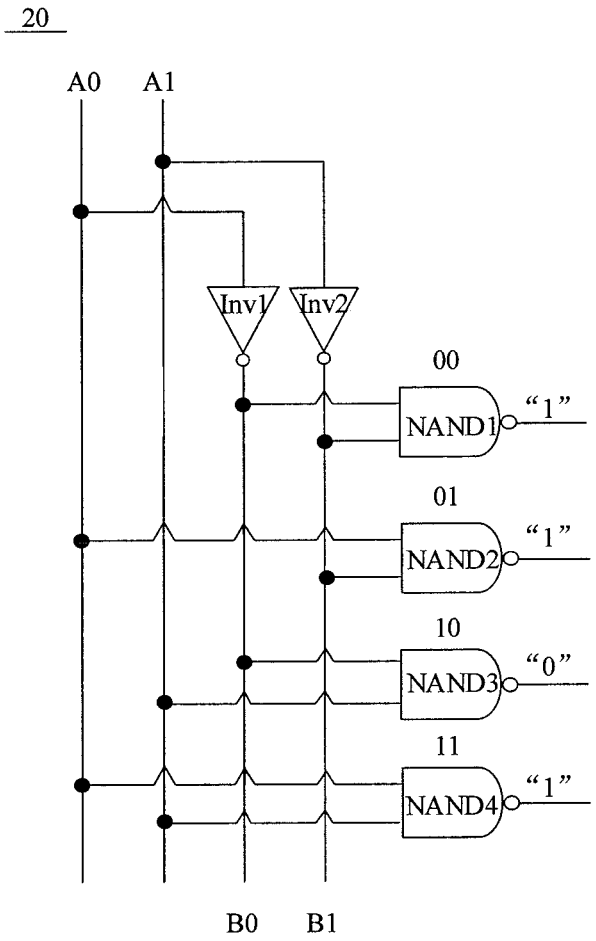
FIG. 4 is a schematic structural diagram of a decoding sub-circuit of FIG. 3.

FIG. 4 is a schematic structural diagram of the decoding sub-circuit of FIG. 3.

As shown in FIG. 4, the decoding sub-circuit 20_A comprises a first inverter Inv1, a second inverter Inv2, a first NAND gate NAND1, a second NAND gate NAND2, a third NAND gate NAND3, and a fourth NAND gate NAND4.

The first inverter Inv1 has an input terminal connected to the first input address line A0 to receive a first bit in the N-bit address data, and the first inverter Inv1 inverts the first bit and outputs the inverted first bit at an output terminal thereof. Similarly, the second inverter Inv2 has an input terminal connected to the second input address line A1 to receive a second bit in the N-bit address data, and the second inverter Inv2 inverts the second bit and outputs the inverted second bit at an output terminal thereof.

The first NAND gate NAND1 has a first input terminal connected to an output terminal of the first inverter Inv1 (i.e., connected to the second input address line B0), a second input terminal connected to an output terminal of the second inverter Inv2 (i.e., connected to the second input address line B1), and an output terminal acting as a first signal output terminal of the decoding sub-circuit 20_A (for example, the signal output terminal Op_A1 described above).

The second NAND gate NAND2 has a first input terminal connected to the first input address line A0, a second input terminal connected to the second input address line B1, and an output terminal acting as a second signal output terminal of the decoding sub-circuit 20_A (for example, the signal output terminal Op_A2 described above).

The third NAND gate NAND3 has a first input terminal connected to the second input address line B0, a second input terminal connected to the first input address line A1, and an output terminal acting as a third signal output terminal of the decoding sub-circuit 20_A (for example, the signal output terminal Op_A3 described above).

The fourth NAND gate NAND4 has a first input terminal connected to the first input address line A0, a second input terminal connected to the first input address line A1, and an output terminal acting as a fourth signal output terminal of the decoding sub-circuit 20_A (for example, the signal output terminal Op_A4 described above).

In this way, a plurality of first input address lines and a plurality of second input address lines are connected to a plurality of logic gates in an arrangement and combination manner, so that input terminals of any two logic gates 202 are connected to address lines in different manners.

In FIG. 4, description is schematically made by taking an example of each of the decoding sub-circuits comprising two inverters and four logic gates and the logic gates being NAND gates. However, it should be apparent to those skilled in the art that the embodiments of the present disclosure are not limited thereto, and numbers and types of inverters and logic gates may be selected as needed. For example, the logic gate 202 described above may comprise at least one of a NAND gate, a NOR gate, an AND gate, or an OR gate. In addition, for the sake of brevity, in FIG. 4, description is schematically made by taking the decoding sub-circuit 20_A as an example, and the other decoding sub-circuits 20_B, 20_C, and 20_D may have similar structures, and will not be described in detail here.

An operation of the gate driving circuit according to the embodiment of the present disclosure will be described below with reference to FIGS. 3 and 4.

In an embodiment of the present disclosure, each of the logic gates 202 may output, to an output terminal thereof, a valid signal indicating that the output terminal is selected or an invalid signal indicating that the output terminal is not selected according to signals at K input terminals of the logic gate 202. For example, the logic gate 202 may perform a logic operation on the signals provided at the K signal input terminals thereof, and output a valid signal or an invalid signal to the output terminal thereof according to a result of the operation. Hereinafter, description will be made by taking an example of the output terminal of the logic gate 202 outputting "0" as a valid signal and outputting "1" as an invalid signal. It will be apparent to those skilled in the art that the embodiments of the present disclosure are not limited thereto, and levels of the valid signal and the invalid signal may be set as needed.

$2^K$ logic gates 202 in each decoding sub-circuit 20 may be related to $2^K$ data values of K-bit data respectively. For example, in FIG. 4, the first NAND gate NAND1 is related to "00"; the second NAND gate NAND2 is related to "01"; the third NAND gate NAND3 is related to "10"; and the fourth NAND gate NAND4 is related to "11". When 2-bit data received at the first input address lines A0 and A1 coincides with a data value related to a certain NAND gate, the NAND gate outputs "0", and other NAND gates output "1". For example, in FIG. 4, when A0=0 and A1=1, an output terminal of the third NAND gate NAND3 outputs "0", and remaining NAND gates NAND1, NAND2, and NAND4 each output "1".

By taking the address data of the driving sub-circuit 10 being eight bits (N=8) as an example, four (M=4) decoding sub-circuits 20 are provided in the gate driving circuit 01. Each of the decoding sub-circuits 20 is connected to two first input address lines and two second input address lines. In this way, the entire gate driving circuit 01 is connected to eight first input address lines (A0, A1 . . . A7) and eight second input address lines (B0, B1 . . . B7), so that 8-bit address data may be divided into four groups to be received, and each decoding sub-circuit 20 receives a group of two bits. Each decoding sub-circuit 20 has four logic gates 202 related to four data values of 2-bit data respectively. Each driving sub-circuit 10 is connected to a total of four output terminals of four logic gates 202 belonging to the four decoding sub-circuits 20 respectively. Therefore, a total of four output terminals of the four logic gates 202 connected to the driving sub-circuit 10 may provide a signal carring 8-bit address data. Therefore, in a case where the number of input terminals of each of the driving sub-circuits 10 in the gate driving circuit 01 may be reduced, the gate driving circuit 01 according to the present disclosure may still ensure that a number of bits of the address data of the driving sub-circuit 10 is constant.

As an example, the address of the driving sub-circuit 10_C in FIG. 3 is "00000010". In a case where the address data received by the gate driving circuit 01 is "00000010", the first input address line A0 connected to the decoding sub-circuit 20_A receives an address code of "1", and the first input address line A1 connected to the decoding sub-circuit 20_A receives an address code of "0". In this case, as shown in FIG. 4, under action of the two inverters Inv1 and Inv2 and the four NAND gates NAND1 to NAND4 in the decoding sub-circuit 20_A, the third NAND gate NAND3 related to "10" outputs a valid signal of "0", and remaining NAND gates NAND1, NAND2, and NAND4 each output an invalid signal of "1".

The first input address line A2 connected to the decoding sub-circuit 20_B receives an address code of "0", and the first input address line A3 connected to the decoding sub-circuit 20_B receives an address code of "0". Similarly, in the decoding sub-circuit 20_B, the logic gate 202 related to "00" outputs a valid signal of "0", and remaining logic gates 202 each output an invalid signal of "1".

The first input address line A4 connected to the decoding sub-circuit 20_C receives an address code of "0", and the first input address line A5 connected to the decoding sub-circuit 20_C receives an address code of "0". Similarly, in the decoding sub-circuit 20_C, the logic gate 202 related to "00" outputs a valid signal of "0", and remaining logic gates 202 each output an invalid signal of "1".

The first input address line A6 connected to the decoding sub-circuit 20_D receives an address code of "0", and the first input address line A7 connected to the decoding sub-circuit 20_D receives an address code of "0". Similarly, the logic gate 202 related to "00" outputs a valid signal of "0", and remaining logic gates 202 each output an invalid signal of "1".

In this way, the third NAND gate NAND3 related to "10" in the decoding sub-circuit 20_A, the first NAND gate NAND1 related to "00" in the decoding sub-circuit 20_B, the first NAND gate NAND1 related to "00" in the decoding sub-circuit 20_C, and the first NAND gate NAND1 related to "00" in the decoding sub-circuit 20_D each output an invalid signal of "0", so that the driving sub-circuit 10_C is selected (for example, chosen) to output a row driving signal. Other driving sub-circuits (for example, 10_A, 10_B, etc.) are not selected.

As may be seen from the above, data values related to the respective logic gates 202 connected to the driving sub-circuit 10_C are sequentially arranged as "00", "00", "00" and "10" in a direction from the decoding sub-circuit 20_D to the decoding sub-circuit 20_A, and thereby the 8-bit address of the driving sub-circuit 10_C is "00000010", so as to select the driving sub-circuit 10_C, and thus the driving sub-circuit 10_C outputs a row driving signal.

Similarly, by inputting the address data of other driving sub-circuits 10 to the gate driving circuit, the other driving sub-circuits 10 related to the address data may be selected, which will not be described in detail here.

The phrase "A connected to B" as described above may refers to "A directly connected to B" or "A indirectly connected to B". For example, in some embodiments, the input terminal of the first inverter Inv1 may be directly connected to one of two signal input terminals of the decoding sub-circuit (e.g. in order to be connected to the first input address line A0). In some embodiments, the input terminal of the second inverter Inv2 may be directly connected to the other of the two signal input terminals (e.g. in order to be connected to the second input address line A1). In some embodiments, the first input terminal of the first NAND gate NAND1 may be directly connected to the output terminal of the first inverter Inv1, and the second input terminal of the first NAND gate NAND1 may be directly connected to the output terminal of the second inverter Inv2. In some embodiments, the first input terminal of the second NAND gate NAND2 may be directly connected to an input terminal of the first inverter Inv1, and the second input terminal of the second NAND gate NAND2 may be directly connected to the output terminal of the second inverter Inv2. In some embodiments, the first input terminal of the third NAND gate NAND3 may be directly connected to the output terminal of the first inverter Inv1, and the second input terminal of the third NAND gate NAND3 may be directly connected to the input terminal of the second inverter Inv2. In some embodiments, a first input terminal of the fourth NAND gate NAND4 may be directly connected to the input terminal of the first inverter Inv1, and the second input terminal of the fourth NAND gate NAND4 may be directly connected to the input terminal of the second inverter Inv2.

A structure of the driving sub-circuit according to the embodiment of the present disclosure will be described below.

Figure 5:
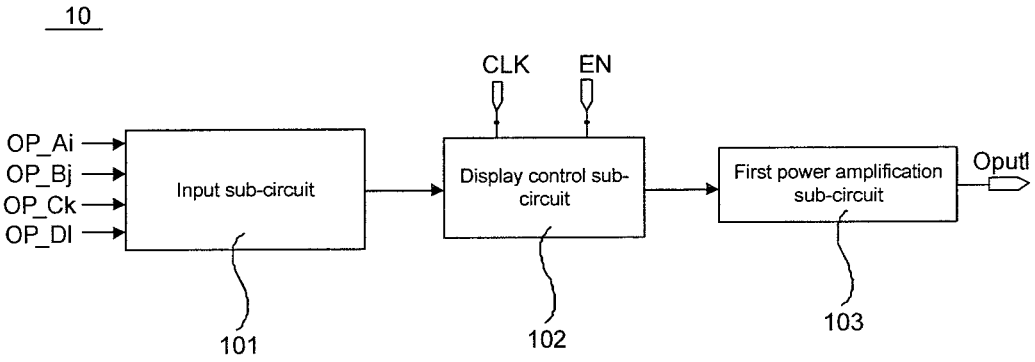
FIG. 5 is a schematic structural diagram of a driving sub-circuit according to an embodiment of the present disclosure.

FIG. 5 is a schematic structural diagram of a driving sub-circuit according to an embodiment of the present disclosure. As shown in FIG. 5, the driving sub-circuit 10 may comprise an input sub-circuit 101, a display control sub-circuit 102, and a first power amplification sub-circuit 103.

For example, for the gate driving circuit of FIG. 2, the input sub-circuit 101 of the driving sub-circuit 10 is connected to a signal output terminal OP_Ai of the decoding sub-circuit 20_A, a signal output terminal OP_Bj of the decoding sub-circuit 20_B, a signal output terminal OP_Ck of the decoding sub-circuit 20_C, and a signal output terminal OP_Dl of the decoding sub-circuit 20_D respectively, where i, j, k and l are integers greater than or equal to 1 and less than or equal to 4. By taking the driving sub-circuit 10_A of FIG. 2 as an example, the input sub-circuit 101 of the driving sub-circuit 10_A is connected to a signal output terminal OP_A4 of the decoding sub-circuit 20_A, a signal output terminal OP_B4 of the decoding sub-circuit 20_B, a signal output terminal OP_C4 of the decoding sub-circuit 20_C, and a signal output terminal OP_D4 of the decoding sub-circuit 20_D.

As shown in FIG. 5, the input sub-circuit 101 is also connected to the display control sub-circuit 102. When the signal output terminals (OP_Ai, OP_Bj, OP_Ck, and OP_Dl) connected to the input sub-circuit 101 output a valid signal (for example, "0"), the input sub-circuit 101 provides a transmission control signal to the display control sub-circuit 102.

The display control sub-circuit 102 is also connected to a clock signal terminal CLK, a display control terminal EN, and the first power amplification sub-circuit 103. As an example, the display control terminal EN may provide a display control signal at a high level (which may, for example, be represented by "1") when a row of sub-pixels controlled by the driving sub-circuit 10 needs to be displayed, and provide a display control signal at a low level (which may, for example, be represented by "0") when the row of sub-pixels controlled by the driving sub-circuit 10 needs not to be displayed.

The display control sub-circuit 102 may perform a logic operation on signals at the clock signal terminal CLK and the display control terminal EN under control of the transmission control signal output by the input sub-circuit 101, and transmit a result of the logical operation to the first power amplification sub-circuit 103.

The first power amplification sub-circuit 103 may amplify the result of the logical operation output by the display control sub-circuit 102 and output the amplified result as a first row driving signal. The first row driving signal is at a high level as a valid level or at a low level as a valid level.

In some embodiments, when a pixel circuit in each sub-pixel of a row of sub-pixels controlled by the driving sub-circuit 10 comprises an N-type transistor as a driving transistor, the driving sub-circuit 10 provides a first row driving signal at a high level to a gate of the N-type transistor through the first power amplification sub-circuit 103 to control the N-type transistor to be turned on.

In some other embodiments, when the pixel circuit comprises a P-type transistor as a driving transistor, the driving sub-circuit 10 may provide a first row driving signal at a low level to a gate of the P-type transistor through the first power amplification sub-circuit 103 to control the P-type transistor to be turned on.

Figure 6:
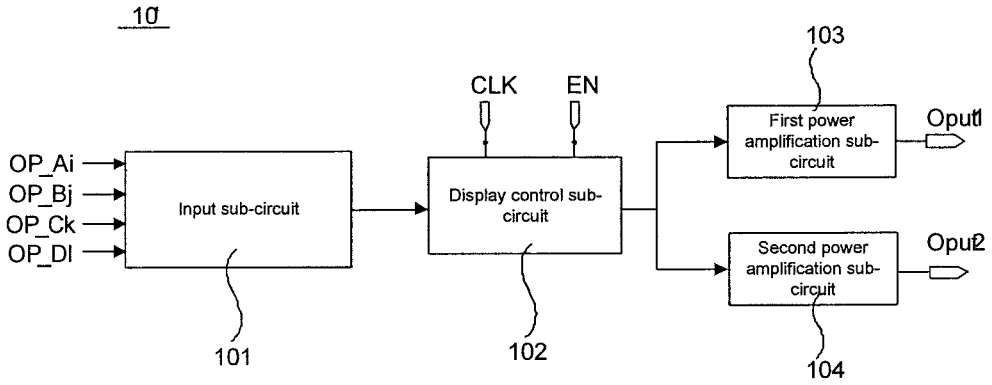
FIG. 6 is a schematic structural diagram of a driving sub-circuit according to another embodiment of the present disclosure.

FIG. 6 is a schematic structural diagram of a driving sub-circuit according to another embodiment of the present disclosure. The driving sub-circuit 10' of FIG. 6 is similar to that of FIG. 5, except at least that the driving sub-circuit 10' further comprises a second power amplification sub-circuit 104. For the sake of brevity, the differences will mainly be described below.

The second power amplification sub-circuit 104 is connected to the display control sub-circuit 102, and the display control sub-circuit 102 may also transmit the result of the logical operation (the result of the logical operation on the signals at the clock signal terminal CLK and the display control terminal EN) to the second power amplification sub-circuit 104.

The second power amplification sub-circuit 104 may amplify the result of the logical operation output by the display control sub-circuit 102 and output the amplified result as a second row driving signal.

The first row driving signal output by the first power amplification sub-circuit 103 and the second row driving signal output by the second power amplification sub-circuit 104 are mutually inverted from each other.

For example, when the first row driving signal output by the first power amplification sub-circuit 103 is at a high level, the second row driving signal output by the second power amplification sub-circuit 104 is at a low level; and when the first row driving signal output by the first power amplification sub-circuit 103 is at a low level, the second row driving signal output by the second power amplification sub-circuit 104 is at a high level. Hereinafter, for convenience of explanation, description is made by taking an example of the first row driving signal output by the first power amplification sub-circuit 103 being at a low level, and the second row driving signal output by the second power amplification sub-circuit 104 being at a high level.

When a driving transistor of the pixel circuit controlled by the driving sub-circuit 10' comprises both an N-type transistor and a P-type transistor, the driving sub-circuit 10 may provide a first row driving signal at a low level to a gate of the P-type transistor through the first power amplification sub-circuit 103 to control the P-type transistor to be turned on. In addition, the driving sub-circuit 10 may provide a second row driving signal at a high level to a gate of the N-type transistor through the second power amplification sub-circuit 104 to control the N-type transistor to be turned on.

Figure 7:
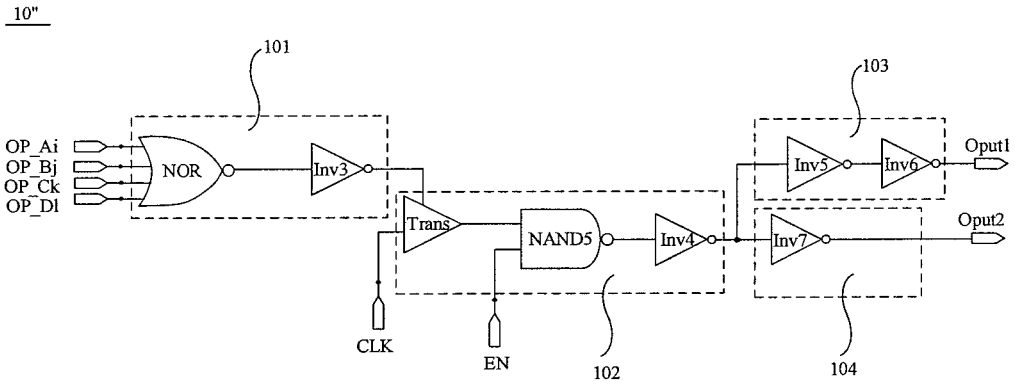
FIG. 7 is a schematic structural diagram of a driving sub-circuit according to still another embodiment of the present disclosure.

FIG. 7 is a schematic structural diagram of a driving sub-circuit according to still another embodiment of the present disclosure. As shown in FIG. 7, the driving sub-circuit 10" may comprise an input sub-circuit 101, a display control sub-circuit 102, a first power amplification sub-circuit 103, and a second power amplification sub-circuit 104. The driving sub-circuit 10" may be applied to a structure of the decoding sub-circuit according to any of the embodiments, for example, the decoding sub-circuit shown in FIG. 4.

The input sub-circuit 101 may comprise a NOR gate NOR and a third inverter Inv3. The NOR gate NOR has a plurality of input terminals, and each of the input terminals is connected to one signal output terminal of each of the decoding sub-circuits 20. In FIG. 7, the NOR gate NOR has four input terminals connected to the signal output terminals OP_Ai, OP_Bj, OP_Ck and OP_Dl respectively. An output terminal of the NOR gate NOR is connected to an input terminal of the third inverter Inv3. An output terminal of the third inverter Inv3 is connected to the display control sub-circuit 102.

The display control sub-circuit 102 comprises a transmission gate Trans, a fifth NAND gate NAND5, and a fourth inverter Inv4.

A control terminal of the transmission gate Trans is connected to the input sub-circuit 101. In FIG. 7, the control terminal of the transmission gate Trans is connected to the output terminal of the third inverter Inv3 in the input sub-circuit 101. The transmission gate Trans has an input terminal connected to a clock signal terminal CLK, and an output terminal connected to a first input terminal of the fifth NAND gate NAND5. The fifth NAND gate NAND5 has a second input terminal connected to a display control terminal EN, and an output terminal connected to an input terminal of the fourth inverter Inv4. An output terminal of the fourth inverter Inv4 is connected to the first power amplification sub-circuit 103.

The first power amplification sub-circuit 103 comprises a fifth inverter Inv5 and a sixth inverter Inv6. The fifth inverter Inv5 has an input terminal connected to an output terminal of the sixth inverter Inv6, and an output terminal connected to an input terminal of the sixth inverter Inv6. An output terminal of the fifth inverter Inv5 acts as a first output terminal Oput1 of the driving sub-circuit 10". The first output terminal Oput1 is configured to output the first row driving signal. A size of each of the fifth inverter Inv5 and the sixth inverter Inv6 is greater than that of the fourth inverter Inv4, so that the fifth inverter Inv5 and the sixth inverter Inv6 may revert input signals thereof respectively while amplifying a signal output by the fourth inverter Inv4, so that the first row driving signal may drive a transistor in a row of sub-pixels controlled by the driving sub-circuit 10" which is connected to the first output terminal Oput1.

The second power amplification sub-circuit 104 may comprise a seventh inverter Inv7. The seventh inverter Inv7 has an input terminal connected to the output terminal of the fourth inverter Inv4, and an output terminal acting as a second output terminal Oput2 of the driving sub-circuit 10". The second output terminal Oput2 is configured to output a second row driving signal. A size of the seventh inverter Inv7 may be greater than that of the fourth inverter Inv4, so that the seventh inverter Inv7 may revert the signal provided by the fourth inverter Inv4 while amplifying the signal output by the fourth inverter Inv4, so that the second row driving signal may drive a transistor in a row of sub-pixels controlled by the driving sub-circuit 10" which is connected to the second output terminal Oput2.

The first power amplification sub-circuit 103 has two inverters (the fifth inverter Inv5 and the sixth inverter Inv6), the second power amplification sub-circuit 104 has one inverter (the seventh inverter Inv7), and the first power amplification sub-circuit 103 and the second power amplification sub-circuit 104 are both connected to the output terminal of the fourth inverter Inv4 in the display control sub-circuit 102. Therefore, the first power amplification sub-circuit 103 may invert the signal output by the fourth inverter Inv4 twice, and the second power amplification sub-circuit 104 may invert the signal output by the fourth inverter Inv4 once, so that the first row driving signal output by the first power amplification sub-circuit 103 and the second row driving signal output by the second power amplification sub-circuit 104 may be inverted from each other.

An operation of the driving sub-circuit 10" shown in FIG. 7 will be exemplified below.

When the signal output terminals OP_Ai, OP_Bj, OP_Ck, and OP_Dl connected to the four input terminals of the NOR gate NOR respectively output "0", the output terminal of the NOR gate NOR outputs "1". "1" output by the NOR gate NOR becomes "0" after being reverted by the third inverter Inv3, and "0" is received by the control terminal of the transmission gate Trans, so that the transmission gate Trans is turned on to transmit a clock signal provided at the clock signal terminal CLK to the first input terminal of the fifth NAND gate NAND5.

When a row of sub-pixels controlled by the driving sub-circuit 10" needs to be displayed, the display control terminal EN provides "1". At this time, if the clock signal terminal CLK provides "0", the fifth NAND gate NAND5 outputs "1".

"1" output by the fifth NAND gate NAND5 becomes "0" after being reverted by the fourth inverter Inv4, and "0" is input to the first power amplification sub-circuit 103 and the second power amplification sub-circuit 104.

The fifth inverter Inv5 and the sixth inverter Inv6 in the first power amplification sub-circuit 103 sequentially invert the signal output by the third inverter Inv3, so that the first output terminal Oput1 of the driving sub-circuit 10" outputs a first row driving signal at a low level ("0"). The first row driving signal may enable a P-type transistor in a pixel circuit controlled by the driving sub-circuit 10" which is connected to the first output terminal Oput1 of the driving sub-circuit 10" to be turned on.

The seventh inverter Inv7 in the second power amplification sub-circuit 104 inverts the signal output by the fourth inverter Inv4, so that the second output terminal Oput2 of the driving sub-circuit 10" outputs a second row driving signal at a high level ("1"). The second row driving signal may enable an N-type transistor in the pixel circuit controlled by the driving sub-circuit 10" which is connected to the second output terminal Oput2 of the driving sub-circuit 10" to be turned on.

It should be illustrated that when a driving transistor in the pixel circuit controlled by the driving sub-circuit 10" is an N-type transistor or a P-type transistor, one of the first output terminal Oput1 or the second output terminal Oput2 of the sub-circuit 10", for example, the first output terminal Oput1, is connected to a gate of the driving transistor, and the other of the first output terminal Oput1 or the second output terminal Oput2, for example, the second output terminal Oput2, may be suspended.

Some embodiments of the present application provide a display apparatus comprising any of the gate driving circuits described above. The above display apparatus may be a liquid crystal display apparatus or an organic light emitting diode display apparatus. For example, the display apparatus may be any product or component having a display function such as a display, a television, a digital photo frame, a mobile phone or a tablet etc. The above display apparatus has the same technical effects as those of the gate driving circuit provided in the above embodiments, and will not be described in detail here.

The embodiments of the present disclosure further provide a method for controlling any of the gate driving circuits described above.

Figure 8:
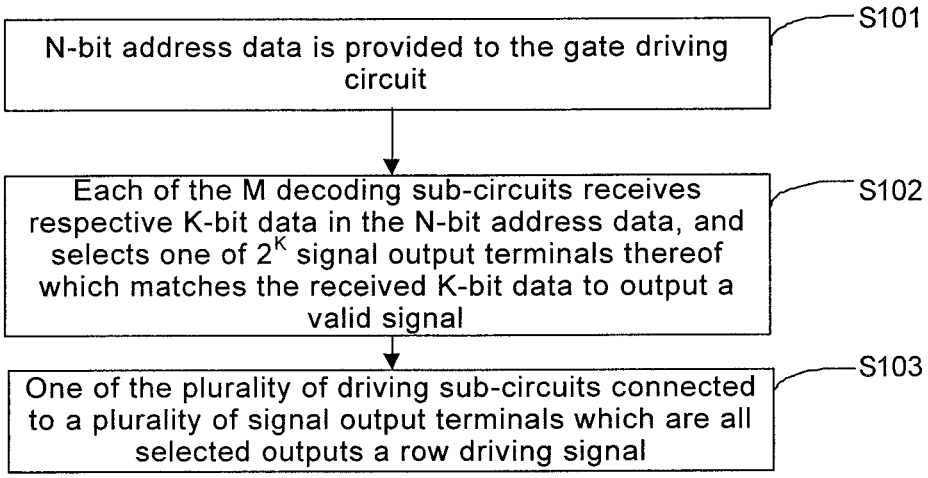
FIG. 8 is a flowchart of a method for controlling a gate driving circuit according to an embodiment of the present disclosure.

FIG. 8 is a flowchart of a method for controlling a gate driving circuit according to an embodiment of the present disclosure. This control method may be applied to the gate driving circuit according to any of the embodiments described above. As shown in FIG. 8, the method comprises steps S101 to S103.

In step S101, N-bit address data is provided to the gate driving circuit. For example, when N=8, the address data may be 00000000, 00000001, 00000010, 00000011, . . . . Description will be made below by taking the address data being "00000010" as an example.

In step S102, each of the M decoding sub-circuits receives respective K-bit data in the N-bit address data, and selects one of $2^K$ signal output terminals thereof which matches the received K-bit data to output a valid signal.

For example, when M=4 and K=2, by taking the gate driving circuit shown in FIGS. 3 and 4 as an example, each decoding sub-circuit 20 receives two bits in 8-bit address data to be decoded in the manner described above, and selects one of the four signal output terminals thereof to output a valid signal.

In step S103, one of the plurality of driving sub-circuits connected to a plurality of signal output terminals which are all selected outputs a row driving signal. For example, when a signal output terminal of each of the decoding sub-circuits 20 connected to the driving sub-circuit 10 outputs a valid signal, the driving sub-circuit 10 outputs a row driving signal.

For example, also by taking the gate driving circuit shown in FIGS. 3 and 4 as an example, in the manner described above, the driving sub-circuit 10_C is selected by the address data of "00000010" provided in step S101 to output a row driving signal.

Figure 9:
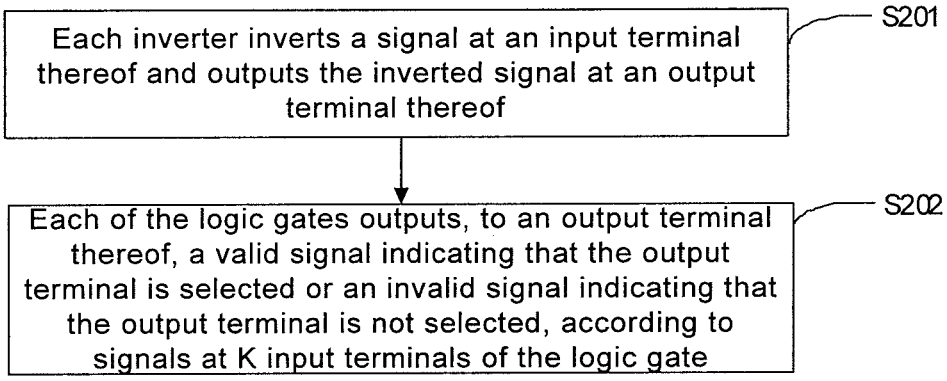
FIG. 9 is a flowchart of an example of step S102 in the control method of FIG. 8.

FIG. 9 is a flowchart of one example of step S102 in the control method of FIG. 8.

Each of the signal input terminals of the decoding sub-circuit 20 shown in FIG. 3 is connected to a first input address line (for example, A0, A1), each of the first input address lines is configured to receive an address code, and in a case where the decoding sub-circuit 20 comprises K inverters 201 and $2^K$ logic gates 202, as shown in FIG. 9, the above S102 comprises S201 to 203.

In step S201, each inverter inverts a signal at an input terminal thereof and outputs the inverted signal at an output terminal thereof.

For example, a plurality of first input address lines (A0, A1, A2, A3, A4, A5, A6, and A7) sequentially receive each bit of the address code in the address data. By taking the address data being "00000010" as an example, the first input address line A0 receives an address code of "0"; the first input address line A1 receives an address code of "1"; the first input address line A2 receives an address code of "0"; the input address line A3 receives an address code of "0"; the first input address line A4 receives an address code of "0"; the first input address line A5 receives an address code of "0"; the first input address line A6 receives an address code of "0", and the first input address line A7 receives an address code of "0".

Each of the inverters inverts an address code on one first input address line (for example, the address line A0, A1, A2, A3, A4, A5, A6, or A7) and outputs the inverted address code to a second input address line (B0, B1, B2, B3, B4, B5, B6 or B7).

In step S202, each of the logic gates outputs, to an output terminal thereof, a valid signal indicating that the output terminal is selected or an invalid signal indicating that the output terminal is not selected, according to signals at K input terminals of the logic gate. For example, each logic gate 202 performs a logic operation on signals provided at a first input terminal and a second input terminal thereof, and outputs a valid signal or an invalid signal to an output terminal thereof according to a result of the operation. Here, one of $2^K$ signal output terminals of each decoding sub-circuit 20 outputs a valid signal. For example, an output terminal of the logic gate 202 may output "0" as a valid signal, and output "1" as an invalid signal.

For example, as described above, in a case where the received address data is "00000010", in the decoding sub-circuit 20_A, a logic gate 202 related to "10" outputs a valid signal of "0", and remaining logic gates 202 output an invalid signal of "1"; in the decoding sub-circuit 20_B, a logic gate 202 related to "00" outputs a valid signal of "0", and remaining logic gates 202 output an invalid signal of "1"; in the decoding sub-circuit 20_C, a logic gate 202 related to "00" outputs a valid signal of "0", and remaining logic gates 202 output an invalid signal of "1"; and in the decoding sub-circuit 20_D, a logic gate 202 related to "00" outputs a valid signal of "0", and remaining logic gates 202 output an invalid signal of "1"

In this case, the signal output terminals of the respective logic gates 202 in the same decoding sub-circuit 20 may have address data composed of K (for example, K=2) bit address codes. In this case, even if one driving sub-circuit 10 is connected to output terminals of M (M=4) logic gates 202 belonging to different decoding sub-circuits 20 respectively, each logic gate 202 is related to respective data values of 2-bit data. Therefore, the four logic gates 202 connected to the driving sub-circuit 10 may be used for the conversion of 8-bit address data.

For example, the address data at the output terminals of the four logic gates 202 connected to the driving sub-circuit 10 are sequentially arranged as "00", "00", "00", and "10" in a direction from the decoding sub-circuit 20_D to the decoding sub-circuit 20_A, that is, the 8-bit address data of the driving sub-circuit 10_C is "00000010", to select the driving sub-circuit (driving sub-circuit 10_C).

Figure 10:
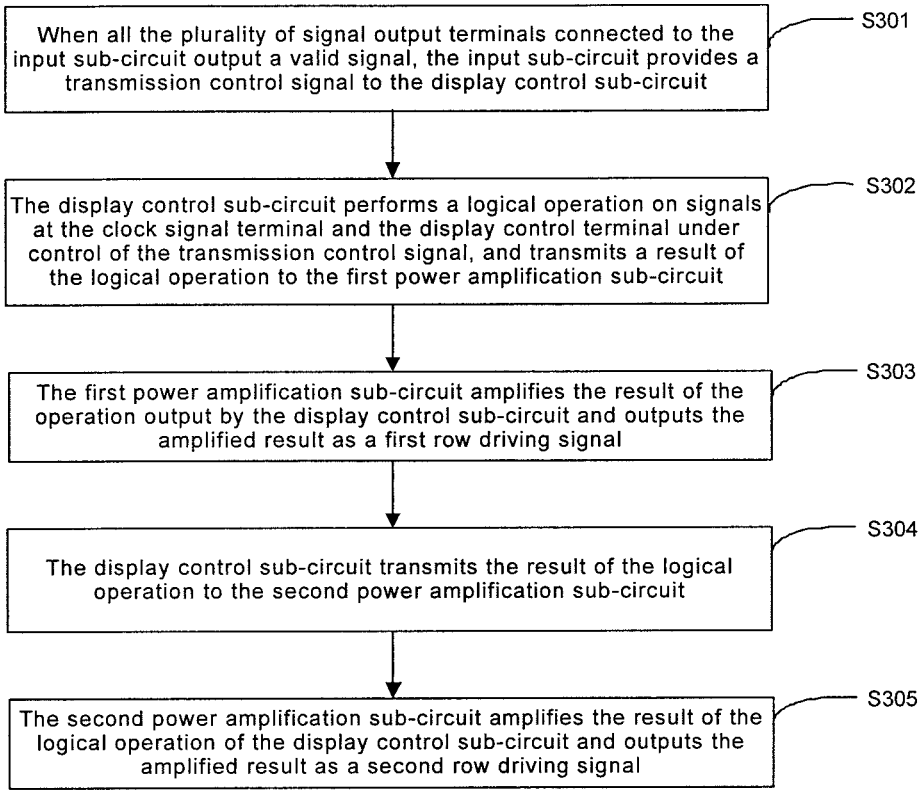
FIG. 10 is a flowchart of an example of step S103 in the control method of FIG. 8.

FIG. 10 is a flowchart of one example of step S103 in the control method of FIG. 8.

Further, in a case where the driving sub-circuit 10 comprises the input sub-circuit 101, the display control sub-circuit 102, and the first power amplification sub-circuit 103 as shown in FIG. 5, as shown in FIG. 10, the above step S103 comprises steps S301 to S303.

In step S301, when all the signal output terminals (for example, OP_Ai, OP_Bj, OP_Ck, and OP_Dl) connected to the input sub-circuit 101 output a valid signal, the input sub-circuit 101 provides a transmission control signal to the display control sub-circuit 102.

In step S302, the display control sub-circuit 102 performs a logical operation on signals at the clock signal terminal CLK and the display control terminal EN under control of the transmission control signal output by the input sub-circuit 101, and transmits a result of the logical operation to the first power amplification sub-circuit 103.

In step S303, the first power amplification sub-circuit 103 amplifies the result of the logical operation output by the display control sub-circuit 102 and outputs the amplified result as a first row driving signal.

In a case where the driving sub-circuit further comprises the second power amplification sub-circuit 104 as shown in FIG. 6, after the input sub-circuit 101 provides the transmission control signal to the display control sub-circuit 102, the above step S103 further comprises step S304.

In step S304, the display control sub-circuit 102 transmits the result of the logical operation to the second power amplification sub-circuit 104.

In step S305, the second power amplification sub-circuit 104 amplifies the result of the logical operation output by the display control sub-circuit 102 and outputs the amplified result as a second row driving signal.

The first row driving signal at the output terminal of the first power amplification sub-circuit 103 and the second row driving signal output by the second power amplification sub-circuit 104 are mutually inverted from each other.

When structures of the input sub-circuit 101, the display control sub-circuit 102, the first power amplification sub-circuit 103, and the second power amplification sub-circuit 104 are as shown in FIG. 6, the method for controlling the driving sub-circuit 10 is the same as described above, and will not be described in detail here.

It may be understood by those of ordinary skill in the art that all or a part of steps of implementing the method embodiments may be completed by program instructing related hardware. The above program may be stored in a computer readable storage medium, and the program, when executed, implements the steps of the method embodiments. The above storage medium comprises various media which may store program codes, such as a Read Only Memory (ROM), a Random Access Memory (RAM), a magnetic disk, or an optical disk etc.

The above description is only specific embodiments of the present disclosure, but the protection scope of the present disclosure is not limited thereto. Changes or substitutions which may be easily reached by any person skilled in the art within the technical scope of the present disclosure should be covered by the protection scope of the present disclosure. Therefore, the protection scope of the present disclosure should be determined by the scope of the appended claims.

We claim:

1. A gate driving circuit, comprising:

M decoding sub-circuits, wherein each of the M decoding sub-circuits has K signal input terminals and $2^K$ signal output terminals, where K=N/M, M, N and K are positive integers, $4 \leq M < N$, and $K \geq 2$, N signal input terminals of the M decoding sub-circuits are connected to receive N-bit address data, and each of the M decoding sub-circuits is configured to receive respective K-bit data in the N-bit address data at K signal input terminals thereof, and select one of the $2^K$ signal output terminals thereof which matches the received K-bit data; and a plurality of driving sub-circuits, wherein each of the plurality of driving sub-circuits is connected to M signal output terminals belonging to the M decoding sub-circuits respectively according to an address allocated thereto, and is configured to output a row driving signal when the M signal output terminals connected to the driving sub-circuit are all selected.

2. The gate driving circuit according to claim 1, wherein the decoding sub-circuit comprises:

K inverters, wherein each of the K inverters has an input terminal connected to a respective one of the K signal input terminals, and is configured to invert a signal at an input terminal thereof and output the inverted signal at an output terminal thereof; and $2^K$ logic gates, wherein each of the $2^K$ logic gates has K input terminals connected to K inverters respectively with each of the K input terminals being connected to an input terminal or output terminal of a respective one of the K inverters, and an output terminal acting as one of the $2^K$ signal output terminals of the decoding sub-circuit, and each of the logic gates is configured to output, to the output terminal thereof, a valid signal indicating that the output terminal is selected or an invalid signal indicating that the output terminal is not selected according to signals at K input terminals of the logic gate.

3. The gate driving circuit according to claim 2, wherein the logic gate comprises at least one of a NAND gate, a NOR gate, an AND gate or an OR gate.

4. The gate driving circuit according to claim 2, wherein N=8, M=4, K=2, the K inverters comprises a first inverter and a second inverter, and the $2^K$ logic gates comprise a first NAND gate, a second NAND gate, a third NAND gate, and a fourth NAND gate, wherein an input terminal of the first inverter is connected to one of two signal input terminals of the decoding sub-circuit;

an input terminal of the second inverter is connected to the other of the two signal input terminals;

the first NAND gate has a first input terminal connected to an output terminal of the first inverter, a second input terminal connected to an output terminal of the second inverter, and an output terminal acting as a first signal output terminal of the decoding sub-circuit;

the second NAND gate has a first input terminal connected to an input terminal of the first inverter, a second input terminal connected to the output terminal of the second inverter, and an output terminal acting as a second signal output terminal of the decoding sub-circuit;

the third NAND gate has a first input terminal connected to the output terminal of the first inverter, a second input terminal connected to the input terminal of the second inverter, and an output terminal acting as a third signal output terminal of the decoding sub-circuit; and the fourth NAND gate has a first input terminal connected to the input terminal of the first inverter, a second input terminal connected to the input terminal of the second inverter, and an output terminal acting as a fourth signal output terminal of the decoding sub-circuit.

5. The gate driving circuit according to claim 1, wherein the driving sub-circuit comprises:

an input sub-circuit connected to one of the $2^K$ signal output terminals of each of the decoding sub-circuits and configured to provide a transmission control signal when the signal output terminals connected to the input sub-circuit are all selected;

a display control sub-circuit connected to the input sub-circuit, a clock signal terminal, and a display control terminal, and configured to perform a logic operation on signals at the clock signal terminal and the display control terminal under control of the transmission control signal from the input sub-circuit; and a first power amplification sub-circuit connected to the display control sub-circuit and configured to amplify a result of the logical operation of the display control sub-circuit and output the amplified result as a first row driving signal.

6. The gate driving circuit according to claim 5, wherein the input sub-circuit comprises:

a NOR gate having M input terminals connected to the M decoding sub-circuits respectively, wherein each of the M input terminals is connected to a respective one of signal output terminals of a respective decoding sub-circuit; and a third inverter having an input terminal connected to an output terminal of the NOR gate, and an output terminal connected to the display control sub-circuit to provide the transmission control signal to the display control sub-circuit.

7. The gate driving circuit according to claim 5, wherein the display control sub-circuit comprises:

a transmission gate having a control terminal connected to the input sub-circuit to receive the transmission control signal, and an input terminal connected to the clock signal terminal;

a fifth NAND gate having a first input terminal connected to an output terminal of the transmission gate, and a second input terminal connected to the display control terminal; and a fourth inverter having an input terminal connected to the output terminal of the fifth NAND gate, and an output terminal connected to the first power amplification sub-circuit.

8. The gate driving circuit according to claim 7, wherein the first power amplification sub-circuit comprises:

a fifth inverter having an input terminal connected to the output terminal of the fourth inverter; and a sixth inverter having an input terminal connected to the output terminal of the fifth inverter, and an output terminal acting as a first output terminal of the driving sub-circuit for outputting the first row driving signal.

9. The gate driving circuit according to claim 8, wherein a size of each of the fifth inverter and the sixth inverter is greater than that of the fourth inverter.

10. The gate driving circuit according to claim 5, wherein the driving sub-circuit further comprises: a second power amplification sub-circuit connected to the display control sub-circuit, and configured to amplify the result of the logical operation of the display control sub-circuit and output the amplified result as a second row driving signal.

11. The gate driving circuit according to claim 10, wherein the first row driving signal is at a high level, and the second row driving signal is at a low level; or the first row driving signal is at a low level, and the second row driving signal is at a low level.

12. The gate driving circuit according to claim 10, wherein the second power amplification sub-circuit comprises: a seventh inverter having an input terminal connected to the display control sub-circuit to receive the result of the logical operation from the display control sub-circuit, and an output terminal acting as a second output terminal of the driving sub-circuit for outputting the second row driving signal.

13. The gate driving circuit according to claim 12, wherein a size of the seventh inverter is greater than that of the fourth inverter.

14. A display apparatus, comprising the gate driving circuit according to claim 1.

15. A method for controlling the gate driving circuit according to claim 1, comprising:

receiving, by each of the M decoding sub-circuits, respective K-bit data in N-bit address data and selecting one of the $2^K$ signal output terminals of the decoding sub-circuit which matches the received K-bit data; and outputting, by one of the plurality of driving sub-circuits connected to a plurality of signal output terminals which are all selected, a row driving signal.

16. The method according to claim 15, wherein the decoding sub-circuit comprises K inverters and $2^K$ logic gates, wherein each of the inverters has an input terminal connected to a respective one of the K signal input terminals, and is configured to invert a signal at the input terminal thereof and output the inverted signal at an output terminal thereof, each of the logic gates has K input terminals connected to K inverters respectively with each of the K input terminals being connected to an input terminal or output terminal of a respective one of the K inverters, and an output terminal acting as one of the $2^K$ signal output terminals of the decoding sub-circuit; and receiving respective K-bit data in the N-bit address data and selecting one of the $2^K$ signal output terminals of the decoding sub-circuit which matches the received K-bit data comprises:

inverting, by each inverter, a signal at an input terminal thereof and outputting the inverted signal at an output terminal thereof; and outputting, by each of the logic gates, to an output terminal thereof, a valid signal indicating that the output terminal is selected or an invalid signal indicating that the output terminal is not selected, according to signals at K input terminals of the logic gate.

17. The method according to claim 15, wherein the driving sub-circuit comprises an input sub-circuit, a display control sub-circuit, and a first power amplification sub-circuit, and outputting, by one of the plurality of driving sub-circuits connected a plurality of signal output terminals which are all selected, a row driving signal comprises:

providing, by the input sub-circuit, a transmission control signal to the display control sub-circuit when the plurality of signal output terminals connected to the input sub-circuit output a valid signal;

performing, by the display control sub-circuit, a logic operation on signals at the clock signal terminal and the display control terminal under control of the transmission control signal, and transmitting a result of the logical operation to the first power amplification sub-circuit; and amplifying, by the first power amplification sub-circuit, the result of the operation output by the display control sub-circuit and outputting the amplified result as a first row driving signal.

18. The method according to claim 17, wherein the driving sub-circuit further comprises a second power amplification sub-circuit, and the method further comprises:

transmitting, by the display control sub-circuit, the result of the logical operation to the second power amplification sub-circuit; and amplifying, by the second power amplification sub-circuit, the result of the logical operation of the display control sub-circuit and outputting the amplified result as a second row driving signal.

19. The method according to claim 17, wherein the first row driving signal is at a high level, and the second row driving signal is at a low level; or the first row driving signal is at a low level, and the second row driving signal is at a low level.

* * * * *